US009999801B2

(12) United States Patent
Sattele et al.

(10) Patent No.: US 9,999,801 B2
(45) Date of Patent: Jun. 19, 2018

(54) BABY LEG AND FOOT TRAINER

(71) Applicant: KONINKLIJKE PHILIPS N.V., Eindhoven (NL)

(72) Inventors: Vanessa Sattele, Eindhoven (NL); Lucas Jacobus Franciscus Geurts, Best (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days. days.

(21) Appl. No.: 15/102,538

(22) PCT Filed: Nov. 25, 2014

(86) PCT No.: PCT/IB2014/066324
§ 371 (c)(1),
(2) Date: Jun. 8, 2016

(87) PCT Pub. No.: WO2015/087186
PCT Pub. Date: Jun. 18, 2015

(65) Prior Publication Data

US 2016/0346602 A1 Dec. 1, 2016

Related U.S. Application Data

(60) Provisional application No. 61/913,988, filed on Dec. 10, 2013.

(51) Int. Cl.
*A63B 24/00* (2006.01)
*A63B 23/10* (2006.01)
(Continued)

(52) U.S. Cl.
CPC ..... *A63B 23/10* (2013.01); *A63B 21/00069* (2013.01); *A63B 21/026* (2013.01);
(Continued)

(58) Field of Classification Search
CPC ..... A63B 21/0552; A63B 21/023; A63B 21/0622; A63B 21/0087; A63B 5/00;
(Continued)

(56) References Cited

U.S. PATENT DOCUMENTS 1,996,350 A * 4/1935 Schaff ..... A63B 21/068 482/96
2,461,682 A 2/1949 De Ferrari
(Continued)

FOREIGN PATENT DOCUMENTS

| | | |
|---|---|---|
| JP | 2008255533 | 10/2008 |
| WO | 85/03209 | 8/1985 |
| WO | 2010/133988 | 11/2010 |

*Primary Examiner* — Glenn Richman

(57) ABSTRACT

A leg and foot strength training device for infants. The device includes a support bed and a partition at one end of the support bed. The partition cooperates with the support bed to form a cavity. An infant lying on the support bed maybe positioned such that their legs and feet maybe located substantially within cavity. When the infant pushes or kicks his or her legs or feet toward and/or against the partition from within cavity, the partition may provide an amount of resilient resistance against the legs or feet kicks or pushes.

16 Claims, 4 Drawing Sheets

(51) Int. Cl.

| | |
|---|---|
| ***A63B 71/06*** | (2006.01) |
| ***A63B 21/02*** | (2006.01) |
| ***A63B 21/055*** | (2006.01) |
| ***A63B 23/04*** | (2006.01) |
| ***A63B 21/16*** | (2006.01) |
| ***A63B 21/04*** | (2006.01) |
| *A63B 21/00* | (2006.01) |

(52) U.S. Cl.

CPC ..... *A63B 21/04* (2013.01); *A63B 21/0552* (2013.01); *A63B 21/0557* (2013.01); *A63B 21/1672* (2015.10); *A63B 21/4033* (2015.10); *A63B 23/04* (2013.01); *A63B 24/0062* (2013.01); *A63B 24/0087* (2013.01); *A63B 71/0619* (2013.01); *A63B 21/00061* (2013.01); *A63B 2024/0068* (2013.01); *A63B 2024/0093* (2013.01); *A63B 2208/0242* (2013.01); *A63B 2208/0252* (2013.01); *A63B 2208/12* (2013.01); *A63B 2209/08* (2013.01); *A63B 2209/10* (2013.01); *A63B 2209/14* (2013.01); *A63B 2220/51* (2013.01); *A63B 2220/833* (2013.01); *A63B 2225/20* (2013.01); *A63B 2225/50* (2013.01)

(58) Field of Classification Search

CPC ..... A63B 23/10; A63B 23/04; A63B 21/026; A63B 21/0557; A63B 21/00061; A63B 21/00069; A63B 21/4033; A63B 21/1672; A63B 21/04; A63B 71/0619; A63B 24/0062; A63B 24/0087; A63B 2024/00; A63B 2024/68; A63B 2024/0093; A63B 2208/0242; A63B 2208/0252; A63B 2208/12; A63B 2209/08; A63B 2209/10; A63B 2209/14; A63B 2220/51; A63B 2220/833; A63B 2225/20; A63B 2225/50

See application file for complete search history.

(56) References Cited

U.S. PATENT DOCUMENTS

| | | | | | |
|---|---|---|---|---|---|
| 3,622,154 | A * | 11/1971 | Williams | A63B 21/068 | 482/129 |
| 4,706,953 | A * | 11/1987 | Graham | A63B 21/0622 | 482/110 |
| 5,066,005 | A * | 11/1991 | Luecke | A63B 21/0552 | 482/130 |
| 5,312,315 | A * | 5/1994 | Mortensen | A63B 21/0087 | 482/113 |
| 5,728,030 | A * | 3/1998 | Hsieh | A47D 13/043 | 472/15 |
| 6,676,475 | B1 * | 1/2004 | Henderson | A47D 9/02 | 446/227 |
| 8,430,800 | B2 * | 4/2013 | Nolan | A63B 21/023 | 482/121 |
| 8,562,492 | B2 * | 10/2013 | Gerschefske | A63B 5/00 | 482/121 |
| 2004/0019969 | A1 | 2/2004 | Gatten | | |
| 2006/0016005 | A1 | 1/2006 | Roda | | |
| 2007/0061968 | A1 | 3/2007 | Fader | | |
| 2011/0099719 | A1 | 5/2011 | Hardesty | | |
| 2012/0083183 | A1 | 4/2012 | Zheng | | |
| 2012/0094811 | A1 | 4/2012 | Karecki | | |
| 2013/0244533 | A1 | 9/2013 | Elson | | |

* cited by examiner

BABY LEG AND FOOT TRAINER

CROSS REFERENCE TO RELATED APPLICATIONS

This application is the U.S. National Phase application under 35 U.S.C. § 371 of International Application No. PCT/IB2014/066324, filed Nov. 25, 2014, published as WO 2015/087186 on Jun. 18, 2015, which claims the benefit of U.S. Provisional Patent Application No. 61/913,988 filed Dec. 10, 2013. These applications are hereby incorporated by reference herein.

BACKGROUND

1. Field

The present disclosure pertains to devices and methods for leg and foot strength training for infants.

2. Description of the Related Art

For infants, especially those undergoing neonatal care, it may be desired to promote containment to simulate being in the womb. A common technique to confine an infant is swaddling. Swaddling is the practice of wrapping infants in blankets or similar cloth so that movement of the limbs is tightly restricted. However this and similar techniques are generally limited in providing reflex stimulus for limb extension and subsequent flexion recoil as may be needed to strengthen the legs and feet muscles of the infant.

SUMMARY

Accordingly, one or more aspects of the present disclosure relate to a leg and foot strength training device for infants. The leg and foot strength training device comprises a support bed and a partition at one end of the partition. The support bed includes a support surface having dimensions that accommodate an infant. The partition at one end of the support bed is configured to cooperate with the support bed to form a cavity. The partition is configured to provide resilient resistance to force applied from within the cavity.

Another aspect of the present disclosure relates to a method of providing a leg and foot strength training device for infants. The method comprises the operations of: providing a support bed including a support surface having dimensions that accommodate an infant; providing a partition at one end of the support bed configured to cooperate with the support bed to form a cavity, the partition being configured to provide resilient resistance to force applied from within the cavity; and/or other operations.

Still another aspect of present disclosure relates to a leg and foot strength training device for infants. The device comprises supporting means including a support surface having dimensions that accommodate an infant. The device includes partitioning means at one end of the supporting means. The partitioning means located at one end of the supporting means is configured to cooperate with the supporting means to form a cavity. The partitioning means is configured to provide resilient resistance to force applied from within the cavity.

These and other objects, features, and characteristics of the present disclosure, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the disclosure.

DETAILED DESCRIPTION OF EXEMPLARY EMBODIMENTS

Figure 1:
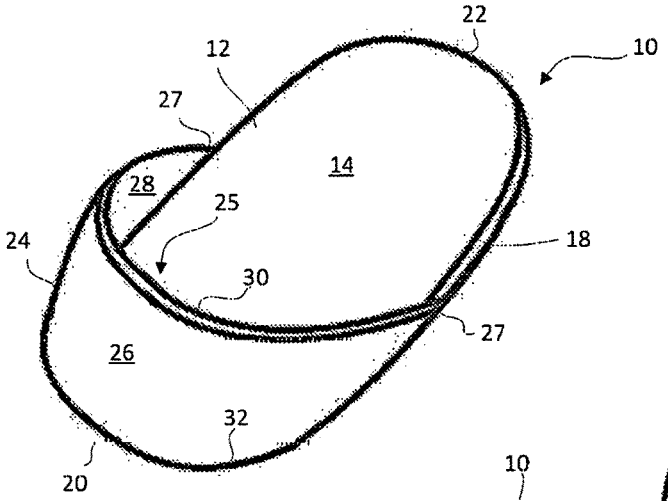
FIG. 1 depicts a perspective view of an embodiment of the leg and foot strength training device for infants comprising a support bed for accommodating an infant and a partition configured to provide resilient resistance to forces applied from within a cavity cooperatively formed by the partition and support bed.

As used herein, the singular form of "a", "an", and "the" include plural references unless the context clearly dictates otherwise. As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other.

As used herein, the word "unitary" means a component is created as a single piece or unit. That is, a component that includes pieces that are created separately and then coupled together as a unit is not a "unitary" component or body. As employed herein, the statement that two or more parts or components "engage" one another shall mean that the parts exert a force against one another either directly or through one or more intermediate parts or components. As employed herein, the term "number" shall mean one or an integer greater than one (i.e., a plurality).

Directional phrases used herein, such as, for example and without limitation, top, bottom, left, right, upper, lower, front, back, and derivatives thereof, relate to the orientation of the elements shown in the drawings and are not limiting upon the claims unless expressly recited therein.

Figure 2:
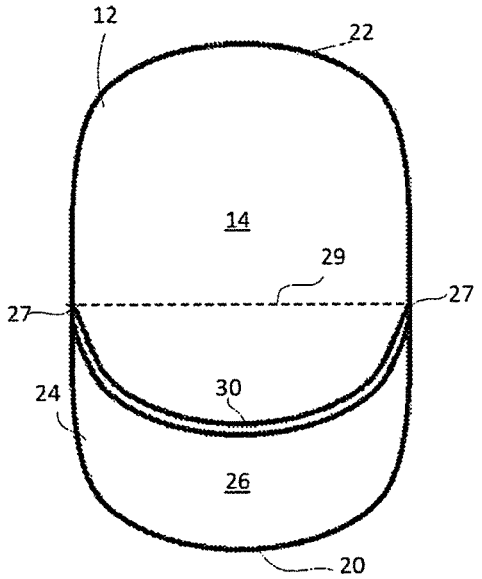
FIG. 2 depicts a top view of the device of FIG. 1.
Figure 3:
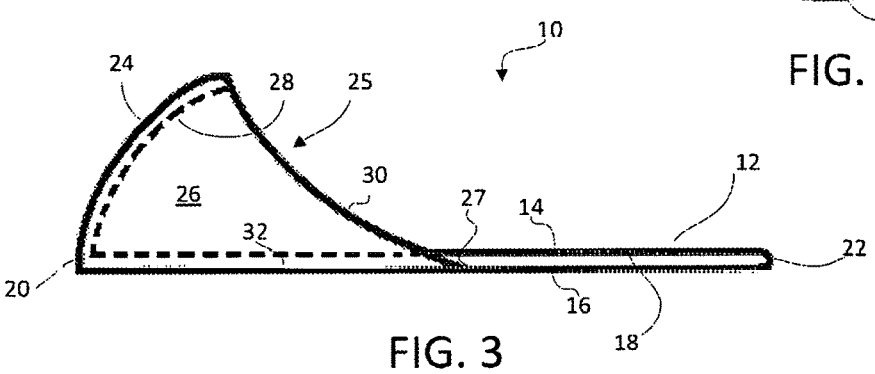
FIG. 3 is a side view of the device of FIG. 1.

FIG. 1, FIG. 2, and FIG. 3 illustrate an exemplary embodiment of leg and foot strength training device 10 of the present invention. In some embodiments, leg and foot strength training device 10 may be a standalone portable structure which can be employed on a support platform deemed suitable by the user, such as a table top. However in other embodiments, those skilled in the art will appreciate that leg and foot strength training device 10 may be integrally incorporated into existing support structures and/or platforms. For example, leg and foot strength training device 10 may be integrally incorporated to comprise some or all of a cradle, a bed, a crib, an incubator, a pad, an operating table, a gurney, a changing table, and/or other supporting means.

Leg and foot strength training device 10 may comprise support bed 12 configured to accommodate an infant. Support bed 12 may be oval in shape and/or may have other dimensions suitable to accommodate an infant. Support bed 12 may have curved ends. Support bed 12 may include first planar support surface 14, second planar surface 16 opposite first planar support surface 14, first end 20, second end 22 opposite first end 20, and peripheral side edge 18 communicating between first planer support surface 14 and second planar surface 16. As noted previously, in some embodiments first planar support surface 14 may comprise some or all of a surface of a crib, bed, pad, cradle, and/or other platform. Support bed 12 may be made of material suitable to provide padding and/or support for an infant lying hereon. For example support bed 12 may be constructed from one or a combination of fabric, closed cell foam, technical textiles such as 3d mesh, 3-dimensional knitted fabric, gel/silicone, memory foam, polyester fiberfill, and/or other suitable material.

Leg and foot strength training device 10 may comprise partition 24 at one end of support bed 12. Partition 24 may be configured to cooperate with support bed 12 to form cavity 25. Briefly, in use, an infant lying on support bed 12 may be positioned such that their legs and feet may be located substantially within cavity 25. When the infant pushes or kicks his or her legs toward and/or against partition 24 from within cavity 25, partition 24 may provide an amount of resilient resistance against the leg kicks or pushes. The resistance may be in the form of the restoring force from partition 24 while being deflected from the force of the leg kicks or pushes. Partition 24 may be constructed of a resilient material and configured to provide resilient resistance to the force of the infant's kicks as part of a leg and foot strength training exercise. In some embodiments, partition 24 may be constructed from the same or similar material as support bed 12. In some embodiments partition 24 may be constructed from fabric, rubber, technical textiles such as 3d mesh, 3-dimensional knitted fabric, gel/silicone, memory foam, polyester fiberfill, and/or other suitable material.

In some embodiments, partition 24 may comprise first surface 26, second surface 28 opposite first surface 26, first edge 30, second edge 32 opposite first edge 30, and ends 27. Partition 24 may be engaged to and/or unitarily formed with support bed 12, for example, at near first end 20. Second edge 32 of partition 24 may be fastened to peripheral side edge 18 of support bed 12 such that second edge 32 wraps around first end 20 of support bed 12. Ends 27 of partition may be engaged at a central location along the length of support bed 12 (e.g., a central location along peripheral side edge 18 between first end 20 and second end 22) to cooperatively form cavity 25 the same or similarly as shown. For example, second edge 32 may be wrapped around first end 20 to follow the curvature of peripheral side edge 18. Second edge 32 and ends 27 may be fastened by means of sewing, stitching, adhesive, mechanical fasteners, and/or other fastening means.

In some embodiments, cavity 25 may be defined by an interior surface area. The interior surface area may comprise some or all of second surface 28 of partition 24 and a portion of the surface area of first planar support surface 14. In FIG. 2, the portion of the surface area of first planar support surface 14 defining at least part of the interior surface area of cavity 25 may be the surface area communicating between first end 20 of support bed 12 and imaginary line 29 at a central location of support bed 12 at or near where ends 27 of partition 24 are fastened. Cavity 25 may be further defined by an opening having a lip comprising first edge 30 and imaginary line 29.

In some embodiments, it may be particularly advantageous to form partition 24 such that a part of the interior surface area of cavity 25 defined by some or all of second surface 28 of partition 24 follows an outwardly curved profile. In this manner partition 24 may cooperate with support bed 12 to form cavity 25 which mimics the curved, or substantially curved, interior shape of a womb and/or other confined space. For example, in FIG. 3, the dashed line depicts the curved profile of second surface 28 at a midpoint between ends 27. Such a curved profile may preferably be maintained for some or all of second surface 28 between ends 27 such that an amount of the interior surface area of cavity 25 defined by second surface 28 follows the curved profile as well.

It is noted that the current depiction of partition 24 and support bed 12 is not intended to be limiting. In other embodiments, partition 24 may be engaged to support bed 12 by other techniques, for example second edge 32 may be engaged to first planar support surface 14 and/or second planar surface 16 of support bed 12; peripheral side edge 18 of support bed 12 may be engaged to second planar surface 28 of partition 24 at or near second side edge 32 of partition 24, and/or may employ other techniques for engagement and/or for otherwise providing support bed 12 with partition 24 at one end.

In some embodiments, leg and foot strength training device 10 may include a partition with more or less curvature than currently shown, and/or other partitioning means at one end of support bed 12. For example, other partitioning means at one end of support bed 12 may include a planar end wall disposed orthogonal to support bed 12 (e.g., no curvature), and/or an end wall with more or less curvature than currently depicted.

Figure 4:
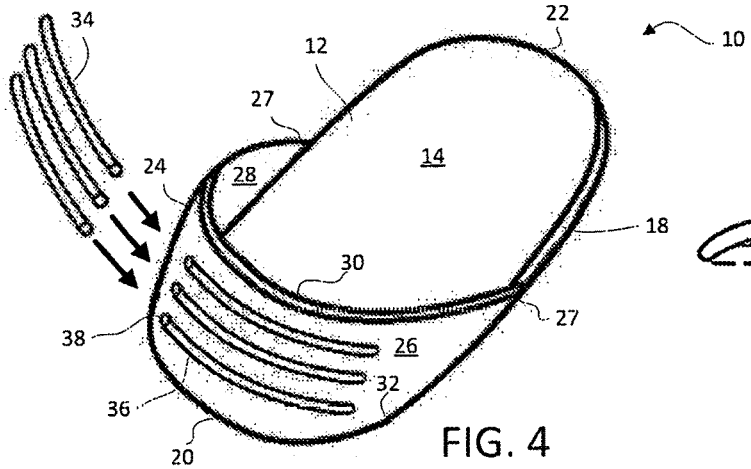
FIG. 4 depicts a perspective view of another embodiment of the leg and foot strength training device for infants including one or more elongated flexure members as a resistance component for controlling an amount of the resilient resistance of the partition.

FIG. 4 shows another exemplary embodiment of leg and foot strength training device 10 comprising a resistance component for controlling an amount of the resilient resistance of partition 24. In the embodiment shown, the resistance component may include one or more elongated flexure members 34. Elongated flexure members 34 may be in the form of bars, rods, or the like, formed from material suitable for the intended purpose of controlling an amount of the resilient resistance of partition 24 when user force from the legs or feet of an infant. For example elongated flexure members 34 may be formed from one or a combination of plastic, rubber, metal, moldable wire mesh, plastics with added carbon fiber, plastics such as nylon, PP, ABS, PC, PET, silicone, and/or other suitable material.

Figure 5:
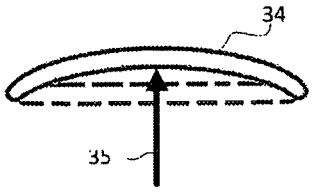
FIG. 5 is a view of a single elongated flexure member used in the embodiment of the device shown in FIG. 4 showing the elongated flexure member deflecting under an applied force.

FIG. 5 shows an illustration of elongated flexure member 34 deflecting under force 35, which may result in elongated flexure member 34 providing an amount of resistive restoring force against the applied force 35. Inclusion of one or more flexure members 34 to the partition 24 may therefore provide a mechanism for controlling an amount of resilient resistance of partition 24. In some embodiments, the quantity, material properties, and/or construction of elongated flexure members 34 (e.g., length, width, material, density, rigidity, resilience, etc.) can be varied to provide different elongated flexure members 34 having different predetermined amounts of resistance under a force.

Elongated flexure members 34 may be selectively interchanged by a caregiver to accommodate the strength, or anticipated strength, of an infant employing leg and foot strength training device 10. In some embodiments, a reference chart may be used by a caregiver when selecting the appropriate elongated flexure members 34 given a height, weight, age, and/or other parameter of the infant. As such, leg and foot strength training device 10, elongated flexure members 34, and/or reference charts may be included in kits or sets including multiple elongated flexure members 34 of different predetermined resistance. Elongated flexure members 34 may include indicia and/or other markings disposed thereon which indicate the level of resistance it may provide (e.g., "10 Newtons", "20 Newtons").

In some embodiments, the resistance component may be removably engageable to partition 24. In the current embodiment of FIG. 4, removable engagement of elongated flexure members 34 to partition 24 may be facilitated through one or more pockets 36 incorporated into partition 24 and/or other means for removable engagement such as removable adhesives, hook and loop fabric, and the like. Pockets 36 may individually include apertures 38 disposed at one or both ends thereof to facilitate receiving elongated flexure members 34 into the respective pockets 36 and to otherwise removably engage elongated flexure members 34 to partition 24. In some embodiments apertures 38 may be closeable to securely enclose elongated flexure members 34 within pockets 36. For example, a flap and/or hook and loop fabric may be employed at the opening of apertures 38 to facilitate secured closure of pockets 36.

In some embodiments, pockets 36 may be unitarily formed with partition 24 (e.g., integrally formed with first surface 26, second surface 28, and/or disposed between surfaces 26, 28 of partition 24). In some embodiments, pockets 36 may be fastened to partition 24 (e.g., first surface 26 and/or second surface 28) by sewing, adhesive, mechanical fasteners, and/or other suitable fastening means.

Figure 6:
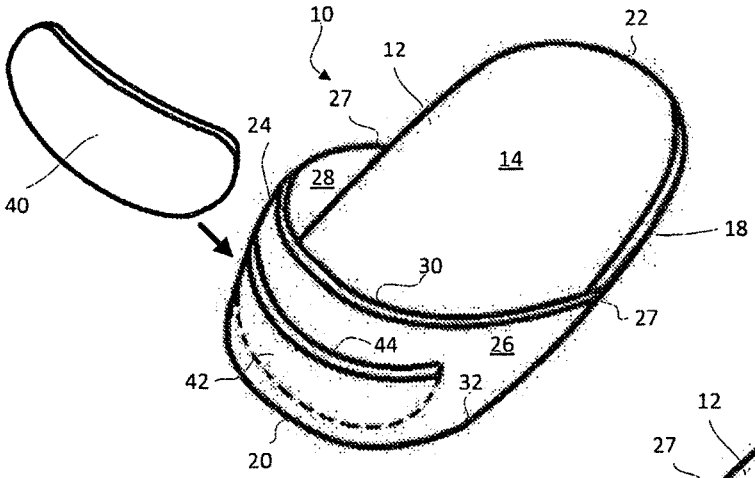
FIG. 6 depicts a perspective view of yet another embodiment of the leg and foot strength training device for infants including a planar flexure member as a resistance component for controlling an amount of the resilient resistance of the partition.

FIG. 6 shows another exemplary embodiment of leg and foot strength training device 10 comprising a resistance component for controlling an amount of the resilient resistance of partition 24. In the embodiment shown, the resistance component may include one or more a planar flexure member 40. Planar flexure member 40 may be in the form of a disc, semi-circular, rectangular, and/or other shape made from material suitable for the intended purpose of controlling an amount of the resilient resistance of partition 24. In some embodiments, it may be desired to employ planar flexure member 40 having a surface area which is 20-100% of the surface area of partition 24 for controlling an amount of resilient resistance of partition 24 based on the surface area covered by planar flexure member 40. In some embodiments, planer flexure member 40 may be formed from one or a combination of plastic, rubber, metal, mesh, molded plastics such as nylon, PP, ABS, PC, PET (e.g., wherein a plastic flexure member may have a molded pattern that facilitates flexure), silicone/gel of different shores, welded sheets of different plastic materials, molded closed cell foam, technical textiles such as 3d mesh, memory foam, and/or other suitable material.

Planar flexure member 40 may similarly deflect when under an applied force or forces from within cavity 25 to provide a resistance against the applied force. In some embodiments, the quantity, material properties, and/or construction (e.g., surface area, material, density, rigidity, resilience, etc.) of planar flexure member 40 may be varied such that different planar flexure members 40 may be associated with a different predetermined amounts of resistance under a given force. Planar flexure member 40 may be selectively interchanged by a caregiver to accommodate the strength, or anticipated strength, of an infant employing leg and foot strength training device 10. As such, planar flexure member 40 may be included in kits or sets including multiple planar flexure members 40 which individually provide a predetermined amount of resistance for easy selection and use by a caregiver.

Removable engagement of planar flexure member 40 to partition 24 may be facilitated through pocket 42 incorporated into partition 24, and/or other means for removable engagement. Pocket 42 may include aperture 44 as an opening of pocket 42, disposed on a side thereof to facilitate receiving planar flexure member 40 into pocket 42 and to otherwise removably engage planar flexure member 40 to partition 24. In some embodiments aperture 44 may be closeable to securely confine planar flexure member 40 within pocket 42. For example, a flap and/or hook and loop fabric fasteners may be employed at aperture 44 to facilitate secure closure thereof. In some embodiment planar flexure member 40 may be employed in multiples similar to the embodiment including multiple elongated flexure members 34 as shown previously (e.g., including multiple pockets 42).

In some embodiments, pocket 42 may be unitarily formed with partition 24 (e.g., integrally formed with first surface 26, second surface 28, and/or disposed between surfaces 26, 28 of partition 24). In some embodiments, pocket 42 may be fastened to partition 24 (e.g., first surface 26 and/or second surface 28) by sewing, adhesive, mechanical fasteners, and/or other suitable fastening means.

Figure 7:
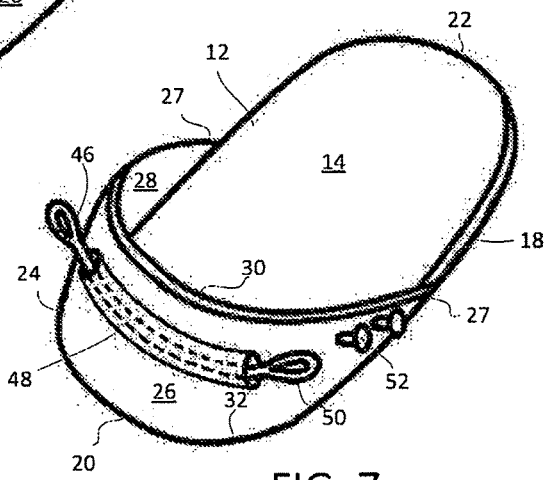
FIG. 7 depicts a perspective view of still another embodiment of the leg and foot strength training device for infants including an elastic member as a resistance component for controlling an amount of the resilient resistance of the partition.
Figure 8:
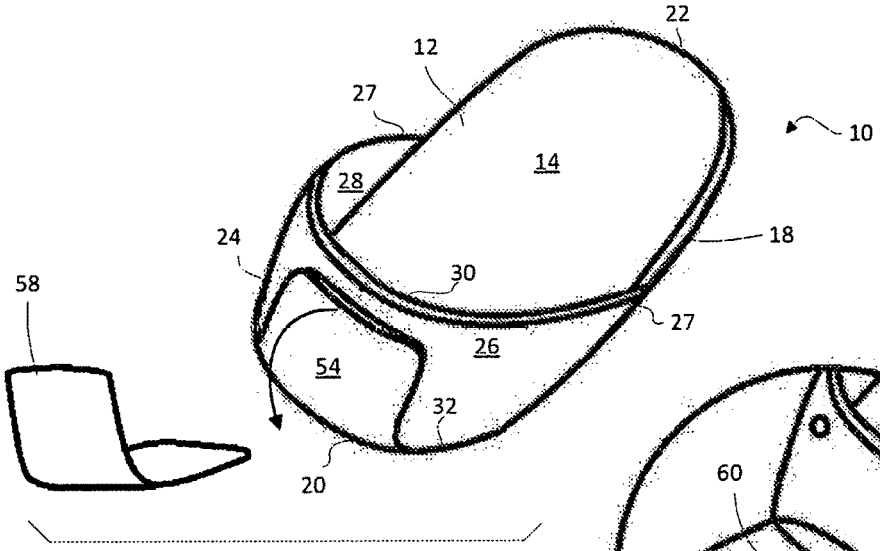
FIG. 8 shows a perspective view of still yet another embodiment of the leg and foot strength training device for infants including a substantially L-shaped member as a resistance component for controlling an amount of the resilient resistance of the partition.

FIG. 7 shows yet another exemplary embodiment of leg and foot strength training device 10 comprising a resistance component for controlling an amount of the resilient resistance of partition 24. In the embodiment shown, the resistance component may include one or more of an adjustable elastic member 46. Elastic member 46 may include looped ends 50 at one or both ends to facilitate removable engagement to mounts 52 included on partition 24. It is briefly noted that opposite side of leg and foot strength training device 10 not shown may also include mounts 52, however in a mirrored configuration. Elastic member 46 may be formed from a material suitable for the intended purpose of controlling an amount of the resilient resistance of partition 24, for example rubber, elastic bands, cord, and/or other resilient elastic material.

Controlling the amount of the resistance elastic member 46 adds to partition 24 may be facilitated by adjusting the amount of axial stress elastic member 46 is under when engaged to partition 24. For example, stretching the elastic member 46 longer by engaging looped ends 50 on mounts 52 which are space the farthest apart (e.g., closest to second end 22), may result in elastic member 46 being tighter and providing relatively more resilient resistance. This may generally stiffen partition 24 to achieve relatively higher resistance to forces applied from within cavity 25. The opposite effect may be achieved by stretching the elastic member 46 less, e.g., engaging looped ends 50 on the closer spaced mounts 52 (e.g., mounts 52 closer to first end 20). It is noted that the quantity of mounts 52 employed on partition 24 may be more or less than shown. For example, more mounts 52 may be employed to facilitate finer incremental adjustments to how much the elastic member 46 is stretched. In addition, it is noted that in some embodiment, mounts 52 may be engaged to other parts of leg and foot strength training device 10 (e.g., to support bed 12 or other location).

In some embodiments, the quantity, material properties, and/or construction (e.g., length, width, material, density, rigidity, resilience, etc.) of elastic member 46 may be varied such that different ones of elastic member 46 may be associated with a different predetermined amounts of resistance. Elastic member 46 may be selectively interchanged by a caregiver to accommodate the strength, or anticipated strength, of an infant employing leg and foot strength training device 10. As such, elastic member 46 may be included in kits or sets including multiple elastic members 46 which individually provide a predetermined amount of resistance for easy selection and use by a caregiver.

Removable engagement of elastic member 46 to partition 24 may be facilitated through channel 48, or a passage, incorporated into partition 24. Channel 48 may include apertures at one or both ends to facilitate receiving the elastic member through channel 48 and to otherwise removably engage the elastic member to partition 24. In some embodiments, channel 48 may be unitarily formed with partition 24 (e.g., integrally formed with first surface 26, second surface 28, and/or disposed between surfaces 26, 28 of partition 24). In some embodiments, channel 48 may be fastened to partition 24 (e.g., to first surface 26 and/or second surface 28) by sewing, adhesive, mechanical fasteners, and/or other suitable fastening means. Removable engagement of elastic member 46 to partition 24 may be provided by other means.

It is noted that the use of looped ends 50 and mounts 52 are provided merely for the illustrative purpose of describing an adjustable embodiment of the resistance component of the leg and foot strength training device 10, and should not be considered limiting. For example, in other embodiments, elastic member 46 may include hook and loop fabric (or other fastener) at one or both ends with complementary hook and loop fabric (or other fastener) employed at the various positions where mounts 52 may be engaged.

FIG. 8, FIG. 9, FIG. 10, and FIG. 11 depict still another exemplary embodiment of leg and foot strength training device 10 comprising a resistance component for controlling an amount of the resilient resistance of partition 24. In the embodiment shown, the resistance component may include one or more a substantially L-shaped flexure member 58. L-shaped flexure member 58 may comprise upper arm 59 which is configured to pivot or deflect with respect to base arm 61 when under an applied force (see, e.g., FIG. 9). This may result in a restoring force of upper arm 59 against the applied force to provide an amount of resistance. When engaged to partition 24, L-shaped flexure member 58 may thereby provide an amount of resistance against the kicks or pushes from the legs or feet of an infant from within cavity 25.

In some embodiments, it may be desired to configure L-shaped flexure member 58 to include upper arm 59 having a surface area which is 20-100% of the surface area of partition 24. L-shaped flexure member 58 may be made from material suitable for the intended purpose of controlling an amount of the resilient resistance of partition 24. In some embodiments, L-shaped flexure member 58 may be formed from one or a combination of plastic, rubber, metal, mesh, molded plastics such as nylon, PP, ABS, PC, PET (e.g., where a plastic flexure member can have a molded pattern that facilitates flexure), silicone/gel of different shores, welded sheets of different plastic materials, molded closed cell foam, technical textiles such as 3d mesh, memory foam, and/or other suitable material.

Figure 10:
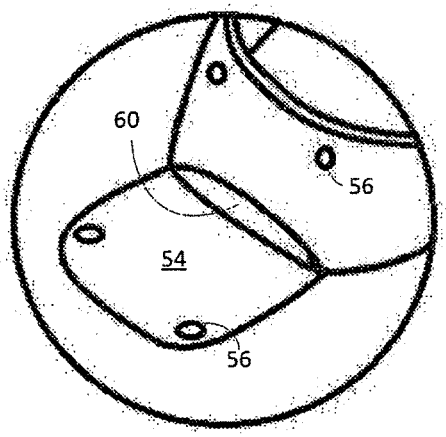
FIG. 10 is a detailed view of the device of FIG. 8 showing a receiving cavity for facilitating removable engagement of the L-shaped resistance component with the device 10.
Figure 9:
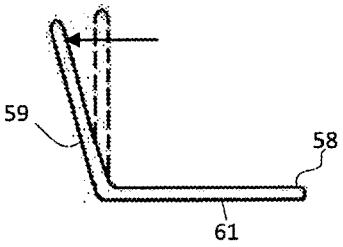
FIG. 9 depicts a side view of the L-shaped resistance component under an applied force.

Removable engagement of L-shaped flexure member 58 to partition 24 may be facilitated through pocket 60 incorporated into partition 24 and/or support bed 12, and/or other removable engagement means (see, e.g., FIG. 10). In some embodiments, pocket 60 may be incorporated as part of support bed 12. For example pocket 60 may extend from an opening at or near first end 20 of support bed 12 a distance into support bed 12 (e.g., positioned between first planar support surface 14 and second planar surface 16). However, the current depiction of pocket 60 is provided merely as an illustrative example and should not be considered limiting. Other techniques in which pocket 60 may be incorporate into leg and foot strength training device 10 to facilitate removable engagement of L-shaped flexure member 58 may also be considered.

Figure 11:
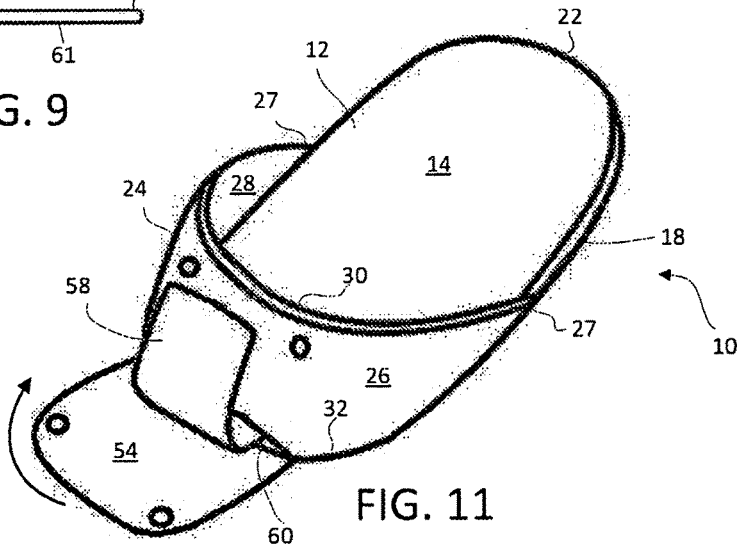
FIG. 11 is another depiction of the device of FIG. 8 showing the L-shaped resistance component inserted into the receiving cavity.

Flap 54, or other closure means, may be incorporated into leg and foot strength training device 10 to secure L-shaped flexure member 58 within pocket 60 and/or otherwise securely engage L-shaped flexure member 58 to partition 24 (e.g., see FIG. 10 with flap 54 in an open position, and FIG. 11 showing L-shaped flexure member 58 having the base arm 61 inserted into pocket 60). Flap 54 may be formed from material the same or similar to that of partition 24, and/or other suitable material. Securement of flap 54 in a closed position (e.g., FIG. 8) may be provided by removable fastening means 56 employed on one or both of flap 54 and partition 24. The removable fastening means 56 may include magnets, hook and loop fabric, mechanical fasteners, and/or other removable fasteners.

In some embodiments, the quantity, material properties, and/or construction of L-shaped flexure member 58 (e.g., shape, surface area and/or length of upper arm 59 and/or base arm 61, material, density, rigidity, resilience, etc.) may be varied such that different ones of L-shaped flexure member 58 may be constructed to be associated with different amounts of resistance. L-shaped flexure member 58 may be selectively interchanged by a caregiver to accommodate the strength, or anticipated strength, of an infant employing the device 10. L-shaped flexure member 58 may be included in kits or sets including multiple ones of L-shaped flexure members 58 which individually provide a predetermined amount of resistance for easy selection and use by a caregiver.

Figure 12:
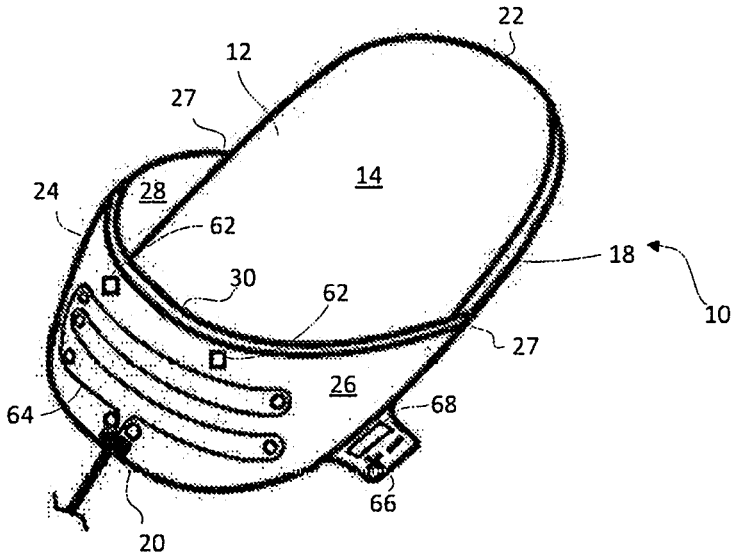
FIG. 12 depicts a perspective view of another embodiment of the leg and foot strength training device for infants including sensors to measure the forced applied from within the cavity and an electromechanical resistance component as a resistance component for automatically adjusting an amount of the resilient resistance of the partition 24.

FIG. 12 shows yet another exemplary embodiment of leg and foot strength training device 10 employing a resistance component for controlling an amount of the resilient resistance of partition 24. The resistance component may be constructed to be adjustable to control an amount of resistance through mechanical, electromechanical, electrical, and/or other techniques. For example one or more of a metallic or semi-metallic wire 64 (or cable) may traverse a portion of partition 24, such as on first surface 26, second surface 28 and/or intermediate the two surfaces 26, 28. Traversing of wire 64 may be accomplished by a series of channels formed in partition 24 which wire 64 is fed through, a series of pulleys engaged to partition 24 for traversing wire 64 across partition 24, and/or other means to engage wire 64 to partition 24.

In some embodiments, wire 64 may comprise shape-memory allow. Wire 64 may be coupled to a power source. In use, controlling an amount of resistance of partition 24 may be accomplished by selectively running a current (e.g., or other trigger such as UV light, heat, etc.) through wire 64 which may cause wire 64 to stiffen, loosen, and/or otherwise change shape such that wire 64 becomes more or less rigid (e.g., resulting in partition 24 being more or less rigid). For example, absent an amount of current, wire 64 may be generally flexible. Application of an amount of current may cause wire 64 to stiffen and/or return to a shape which causes at least the portion of partition 24 with which wire 64 traverses to also become stiffer and more resistant to forces applied from within cavity 25.

In some embodiments, wire 64 may be selectively tightened or loosed to effectively stiffen or relax partition 24 to provide varying control of the rigidity and resilient resistance thereof. For example, by relatively tightening wire 64, partition 24 may become more rigid and provide more resistance. For example, wire 64, may be engaged to an electric motor (e.g., wound around a gear attached to the motor), actuator, electromagnet, and/or other electromechanical means which may facilitate a means for tightening or loosening of wire 64 (e.g., an end of wire 64 can be drawn out from its engagement with partition 24 for tightening, and/or given slack for loosening). In some embodiments, a free end of wire 64 may protrude from leg and foot strength training device 10 such that a user can selectively pull to tighten or provide slack to wire 64 as needed to adjust an amount of resistance of partition 24.

The above examples in which an amount of resistance of partition 24 may be mechanically, electromechanically, and/or electrically adjusted are provided for illustrative purposes only and are not intended to be limiting. For example, an amount of resilient resistance of partition 24 may be controlled by other mechanical, electrical and/or electromechanical means and/or techniques.

In some embodiments, leg and foot strength training device 10 may include user interface 66. User interface 66 may be configured to allow a user (e.g., caregiver) to selectively adjust an amount of resistance of partition 24 via one or more of the mechanical, electrical, and/or electromechanical techniques described herein and/or other techniques. For example user interface 66 may include "+" and "−" interface elements for increasing (e.g., "+") or decreasing (e.g., "−") an amount of resistance of partition 24 added by the resistance component (e.g., varying an applied current and/or controlling the tension of wire 64. In some embodiments, user interface 66 may be remote from leg and foot strength training device 10, for example, controlled wirelessly from a remote computer (e.g., desktop computer, tablet, smartphone, etc.).

In some embodiments, leg and foot strength training device 10 may include one or more sensors 62 engaged to partition 24. Sensors 62 may be, for example, strain sensors, pressure sensors and/or other sensor means suitable for the intended purposes describe herein. Sensors 62 may be configured to generate output signals conveying information related to one or more parameters of the forces exerted on partition 24 from the kicks or pushes of an infant's feet and/or legs, and/or an amount of resilient resistance force provided by partition 24. Sensors 62 may comprise one or more sensors that measure such parameters directly. Sensors 62 may comprise one or more sensors that generate surrogate output signals related to the one or more parameters indirectly. For example, sensors 64 may comprise one or more sensors configured to generate an output related to the resistance provided by partition 24 based on an amount of deflection of partition 24.

In some embodiments, leg and foot strength training device 10 may include visual display 68 configured to provide a visual read out of the applied force and/or resistive force of partition 24 (e.g., determined from output signals of sensors 64). This may aid a caregiver in selecting and/or monitoring the resistance provided by partition 24 as needed for customizing strength training regimes for an infant employing leg and foot strength training device 10. In some embodiments, visual display 68 may be configured to display the measured force of the legs and feet kicks over time and visualize it in a comparison chart that depicts the expected growth (e.g., expecting strength increase and/or improvement) of the infant in the current regiment.

In some embodiments, leg and foot strength training device 10 may be configured to automatically adjust an amount of the resilient resistance of partition 24. For example, leg and foot strength training device 10 may include one or more processors configured to run computer programs for monitoring the output signals of sensors 62. Leg and foot strength training device 10 may be configured to determine, based on the monitored signals, that the infant may be exerting a threshold, or near threshold amount of force against partition 24, and that the an amount of the resilient resistance of partition 24 should be increased (or decreased). Therefore, employing one or more of the mechanical and/or electromechanical resistance component(s) described herein, leg and foot strength training device 10 may be configured to automatically make adjustments to the resistance component(s) such that partition 24 may provide an appropriate amount of resistance.

In some embodiments, leg and foot strength training device 10 may provide a notification, alert and/or suggestion (e.g., via visual display 68, an audible alert, or the like) to a caregiver that the resilient resistance should be adjusted/changed based on monitoring by sensors 62. A caregiver may then manually adjust the resilient resistance as needed.

The descriptions and depictions of leg and foot strength training device 10 provided herein are for illustrative purposes only and should not be considered limiting. As such, it may be considered within the scope and intent of the present disclosure to include modifications to leg and foot strength training device 10 as described herein to provide a strength training device for infants wherein a resistance component can be selectively interchanged by a caregiver as the legs and feet of the infant become stronger.

Figure 13:
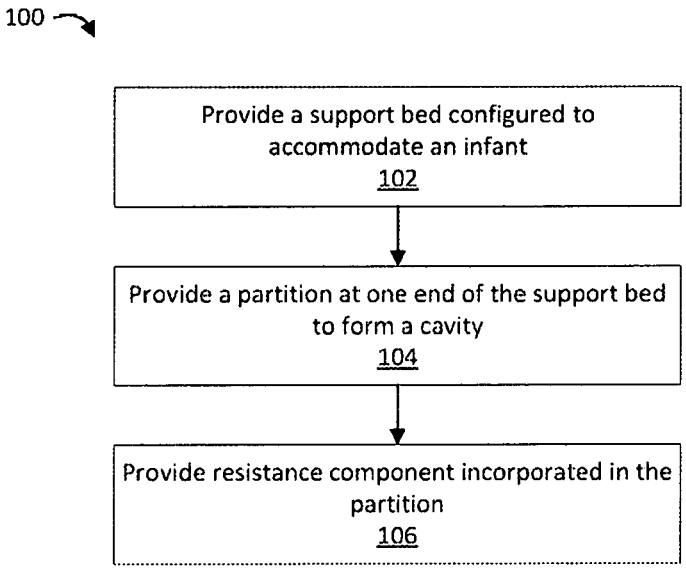
FIG. 13 illustrates a method of providing a leg and foot strength training device for infants.

FIG. 13 illustrates a method 100 of providing a leg and foot strength training device for infants. The operations of method 100 presented below are intended to be illustrative. In some embodiments, method 100 may be accomplished with one or more additional operations not described, and/or without one or more of the operations discussed. Additionally, the order in which the operations of method 100 are illustrated in FIG. 13 and described below is not intended to be limiting.

At an operation 102, a support bed may be provided. In some embodiments, operation 102 is performed with a support bed the same or similar as support bed 12 (shown in FIG. 1-12 and described herein).

At an operation 104, a partition may be provided at one end of the support bed. In some embodiments, operation 104 is performed with a partition the same or similar as partition 24 (shown in FIG. 1-12 and described herein).

At an operation 106, a resistance component incorporated into the partition may be provided. In some embodiments, operation 106 is performed with one or more resistance components such as resistance components 34, 42, 46, 58, and 64 (shown in FIG. 4-12 and described herein).

In the claims, any reference signs placed between parentheses shall not be construed as limiting the claim. The word "comprising" or "including" does not exclude the presence of elements or steps other than those listed in a claim. In a device claim enumerating several means, several of these means may be embodied by one and the same item of hardware. The word "a" or "an" preceding an element does not exclude the presence of a plurality of such elements. In any device claim enumerating several means, several of these means may be embodied by one and the same item of hardware. The mere fact that certain elements are recited in mutually different dependent claims does not indicate that these elements cannot be used in combination.

Although the description provided above provides detail for the purpose of illustration based on what is currently considered to be the most practical and preferred embodiments, it is to be understood that such detail is solely for that purpose and that the disclosure is not limited to the expressly disclosed embodiments, but, on the contrary, is intended to cover modifications and equivalent arrangements that are within the spirit and scope of the appended claims. For example, it is to be understood that the present disclosure contemplates that, to the extent possible, one or more features of any embodiment can be combined with one or more features of any other embodiment.

The invention claimed is:

1. A leg and foot strength training device for infants comprising:

a support bed including a support surface having dimensions that accommodate an infant;

a partition attached to one end of the support bed configured to cooperate with the support bed to form a cavity configured to receive legs and feet of the infant;

one or more resistance components attached to the partition and configured to provide a selectable predetermined amount of resistive force against a force applied from within the cavity by the legs and feet of the infant to provide a reflex stimulus for limb extension and subsequent flexion recoil; and wherein the partition defines at least one pocket, the at least one resistance component being configured to be received in the at least one pocket.

2. The device of claim 1 further including:

a plurality of resistance components configured to be interchangeably received in the at least one pocket, the plurality of resistance components configured to have different predetermined amounts of resistive force.

3. The device of claim 1 wherein the resistance component is adjustable to change to the predetermined amount of the resistive force.

4. The device of claim 1 wherein the partition includes a surface having a curved profile, wherein the cavity formed by the partition and the support bed includes an interior surface area, and wherein at least a portion of the interior surface area follows the curved profile of the surface of the partition.

5. The device of claim 1 wherein the resistance component includes an elongated member and further including means for adjustably tensioning the elongated member to adjust the resistive force.

6. A leg and foot strength training device for infants, comprising:

a support bed including a support surface having dimensions that accommodate an infant;

a partition at one end of the support bed configured to cooperate with the support bed to form a cavity having a confined space, the partition including a resistance component configured to provide a predetermined amount of resistive force against a force applied from within the cavity to provide a reflex stimulus for limb extension and subsequent flexion recoil;

one or more sensors attached to the partition configured to measure the force applied from within the cavity; and wherein the resistance component is automatically adjustable to change the predetermined amount of resistive force based on the measured force.

7. A method of providing a leg and foot strength training device for infants, the method comprising:

forming a support bed including a support surface having dimensions configured to accommodate an infant;

forming a partition at one end of the support bed configured to cooperate with the support bed to form a cavity having a confined space configured to receive feet and legs of the infant supported on the support bed, wherein forming the partition defines at least one pocket;

providing an adjustable resistance component in the partition configured to change a predetermined amount of resistive force against a force applied from within the cavity to provide a reflex stimulus for limb extension and subsequent flexion recoil; and configuring the at least one adjustable resistance component to be received in the at least one pocket.

8. The method of claim 7 further including:

adjusting the resistance component to change the amount of resistive force.

9. The method of claim 7 wherein the resistance component is removably engageable with the partition.

10. The method of claim 7 additionally comprising:

providing one or more sensors for attachment to the partition, the sensors being configured to measure the force applied from within the cavity; and wherein the one or more resistance component is automatically adjusted to change the predetermined amount of resistive force based on the measured force.

11. A leg and foot strength training device for infants comprising:

supporting means for supporting an infant, the supporting means including a support surface having dimensions that accommodate an infant;

partitioning means for partitioning one end of the supporting means, the partitioning means being configured to cooperate with the supporting means to form a cavity having a confined space configured to receive legs and feet of the infant, a resilient resistance means included in the partitioning means and configured to provide a selectable amount of resistive force against a force applied from within the cavity by the infant's legs and feet to provide a reflex stimulus for limb extension and subsequent flexion recoil;

one or more sensor means attached to the partitioning means and configured to measure the force applied from within the cavity; and wherein the resilient resistance means is automatically adjustable to change the amount of resistive force based on the measured force.

12. The device of claim 11 wherein the resilient resistance means configured for removable engagement with the partitioning means.

13. The device of claim 11 wherein the resilient resistance means includes at least one adjustable resistance element configured to adjust the selected amount of resistive force.

14. The device of claim 12 wherein the resilient resistance means includes a plurality of resilient resistive elements configured to provide different predetermined amounts of resistive force, the resistance elements being interchangeably connected with the partition means.

15. The device of claim 13 wherein the resistance element includes an elongated member and further including means for adjustably tensioning the elongated member to adjust the resistive force.

16. The device of claim 15 wherein the elongated member is elastic.

* * * * *